US010739722B2

(12) United States Patent
Zhao et al.

(10) Patent No.: US 10,739,722 B2
(45) Date of Patent: Aug. 11, 2020

(54) CONTROL MECHANISM AND PROCESS CARTRIDGE

(71) Applicant: JIANGXI YIBO E-TECH CO., LTD., Xinyu (CN)

(72) Inventors: Mingsheng Zhao, Xinyu (CN); Liangliang Hu, Xinyu (CN); Shiping Ao, Xinyu (CN); Xiaobing Liu, Xinyu (CN); Mei Yan, Xinyu (CN)

(73) Assignee: JIANGXI YIBO E-TECH CO., LTD., Xinyu, Jiangxi (CN)

( * ) Notice: Subject to any disclaimer, the term of this patent is extended or adjusted under 35 U.S.C. 154(b) by 0 days.

(21) Appl. No.: 16/372,529

(22) Filed: Apr. 2, 2019

(65) Prior Publication Data

US 2019/0227483 A1 Jul. 25, 2019

Related U.S. Application Data

(63) Continuation of application No. PCT/CN2017/000610, filed on Sep. 27, 2017.

(30) Foreign Application Priority Data

Oct. 6, 2016 (CN) ..... 2016 1 0870337
Oct. 7, 2016 (CN) ..... 2016 1 0870541
(Continued)

(51) Int. Cl.
*G03G 15/00* (2006.01)
*G03G 21/18* (2006.01)

(52) U.S. Cl.
CPC ..... *G03G 21/1857* (2013.01); *G03G 21/1814* (2013.01)

(58) Field of Classification Search
CPC ..... G03G 21/1857; G03G 21/1814; G03G 21/186; G03G 21/1864; G03G 21/1821
See application file for complete search history.

(56) References Cited

U.S. PATENT DOCUMENTS 5,903,803 A 5/1999 Kawai et al.
7,106,995 B2 9/2006 Nagai et al.
(Continued)

FOREIGN PATENT DOCUMENTS

CN 203799184 U 8/2014
CN 105137734 A 12/2015
(Continued)

*Primary Examiner* — Hoang X Ngo
(74) *Attorney, Agent, or Firm* — Dragon Sun Law Firm, PC; Jinggao Li, Esq.

(57) ABSTRACT

The present disclosure provides a process cartridge detachably mounted in an imaging device having a driving head. The imaging device includes a force applying assembly that includes a force applying part. The process cartridge includes a developer bearing member that rotates about an axis extending in a first direction; a developing cartridge frame supporting the developer bearing member; a driving force receiving assembly arranged on one side of the developing cartridge frame, the driving force receiving assembly having a power receiving part extending and retracting substantially in the first direction; and a control mechanism controlling the power receiving part to extend and retract, the control mechanism receiving the force of the force applying part to control the extension and retraction of the power receiving part.

19 Claims, 16 Drawing Sheets

(30) Foreign Application Priority Data

| | | |
|---|---|---|
| Oct. 31, 2016 | (CN) | 2016 1 0965235 |
| Nov. 18, 2016 | (CN) | 2016 1 1016324 |
| Dec. 24, 2016 | (CN) | 2016 1 1210797 |

(56) References Cited

U.S. PATENT DOCUMENTS

| | | | | |
|---|---|---|---|---|
| 7,630,624 | B2 | 12/2009 | Chang | |
| 8,090,296 | B2 | 1/2012 | Ito | |
| 8,437,669 | B2 | 5/2013 | Morioka et al. | |
| 8,615,184 | B2 | 12/2013 | Zhou | |
| 8,731,435 | B2 * | 5/2014 | Xu | G03G 21/185 399/111 |
| 9,170,549 | B2 | 10/2015 | Wang | |
| 9,176,467 | B2 | 11/2015 | Gu | |
| 9,846,409 | B2 | 12/2017 | Cao et al. | |
| 2015/0030353 | A1 | 1/2015 | Wang | |
| 2015/0093150 | A1 | 4/2015 | Xiao et al. | |
| 2015/0177683 | A1 | 6/2015 | Gu et al. | |
| 2015/0185693 | A1 | 7/2015 | Wang | |
| 2018/0356763 | A1 | 12/2018 | Ding et al. | |

FOREIGN PATENT DOCUMENTS

| | | | |
|---|---|---|---|
| CN | 105334711 | A | 2/2016 |
| CN | 205157976 | U | 4/2016 |
| CN | 205157977 | U | 4/2016 |

* cited by examiner

CONTROL MECHANISM AND PROCESS CARTRIDGE

CROSS-REFERENCE TO RELATED APPLICATIONS

This application is a bypass continuation application of PCT Application No. PCT/CN2017/000610. This application claims priorities from PCT Application No. PCT/CN2017/000610 filed Sep. 27, 2017, Chinese Application No. 201610870337.7 filed Oct. 6, 2016, Chinese Application No. 201610870541.9 filed Oct. 7, 2016, Chinese Application No. 201610965235.3, filed Oct. 31, 2016, Chinese Application No. 201611016324.X filed on Nov. 18, 2016, and Chinese Application No. 201611210797.3 filed on Dec. 24, 2016, the contents of which are incorporated herein in the entirety by reference.

Some references, which may include patents, patent applications, and various publications, are cited and discussed in the description of the present disclosure. The citation and/or discussion of such references is provided merely to clarify the description of the present disclosure and is not an admission that any such reference is "prior art" to the invention described herein. All references cited and discussed in this specification are incorporated herein by reference in their entireties and to the same extent as if each reference was individually incorporated by reference.

TECHNICAL FIELD

The present disclosure relates to a process cartridge in an imaging device and a control mechanism used in the process cartridge.

BACKGROUND

A process cartridge is a cartridge which can be detachably installed into a main body of an imaging device and comprises a photosensitive cartridge, and the photosensitive cartridge comprises an electrophotographic photosensitive assembly, a charger, etc. The cartridge further comprises a developing cartridge which comprises one of processors such as a developer, a cleaner, etc. The process cartridge is detachably installed relative to the main body of the imaging device for convenience of maintenance. An electrophotographic imaging device using an electrophotographic imaging method functions in the following manner: an electrostatic latent image is formed by selectively exposing the electrophotographic photosensitive assembly which is uniformly charged by the charger under light from the imaging device; the electrostatic latent image is developed with the developer using a toner into a toner image; and the toner image thus formed is transferred onto a recording medium by a transferrer to form an image on a recording material.

The size of the imaging device tends to be smaller and smaller. In order to reduce the transportation cost of the process cartridge and the use cost of users, many manufacturers have made the photosensitive cartridge and the developing cartridge into individually replaceable structures. The service life of one photosensitive cartridge can offset the service life of multiple developing cartridges. When one developing cartridge reaches the service life, users only need to replace the developing cartridge and continue to use the original photosensitive cartridge.

The prior art provides an imaging device and a process cartridge. The process cartridge is divided into a first unit having an image bearing member and a second unit having a developer bearing member. The first unit is mounted in the imaging device in a separately detachable mode, the second unit is also mounted in the imaging device in a separately detachable mode, the second unit having the developer bearing member is detachably mounted in the imaging device along a mounting rail, and the second unit is provided with a force receiving part. A force applying part matched with the force receiving part is arranged in the imaging device, acts on the force receiving part and drives the second unit to move, so that the developer bearing member on the second unit and the image bearing member on the first unit can move between a contact position and a separation position. The second unit is provided with a deflectable universal joint for engaging with a driving head in the imaging device to receive a driving force from the imaging device. The universal joint structure has the following problems: repeated pivoting is required when engaging with and disengaging from the driving head in the imaging device, and unsmooth pivoting of the universal joint may be caused after long-term use, thus affecting the engagement between the universal joint and the driving head; besides, a pivoting center of the universal joint structure may be loosened during transportation due to excessive vibration, resulting in a failure of the universal joint.

Therefore, a heretofore unaddressed need exists in the art to address the aforementioned deficiencies and inadequacies.

SUMMARY

The present disclosure aims to provide a process cartridge to solve the technical problem in the prior art that a universal joint needs to be pivoted repeatedly after being installed in an imaging device, leading to unsmooth pivoting, and therefore the universal joint cannot normally engage with a driving head in the imaging device.

In order to solve the above technical problem, the present invention is realized by the following technical scheme.

The present invention discloses a process cartridge detachably installed in an imaging device, comprising a casing capable of containing a developer; and a developer bearing member which can bear the developer; wherein the developer bearing member can convey the developer to an image bearing member arranged outside a casing of a developing cartridge, and the developer bearing member and the image bearing member can move between a contact position and a separation position. The process cartridge comprises a power receiving part which can extend and retract along a first direction of its own rotation axis direction, and the power receiving part can engage with the driving head to receive a driving force from the driving head. The process cartridge further comprises a control mechanism which controls the extension and retraction of the power receiving part, and the control mechanism urges the developer bearing member to make contact with the image bearing member at a certain pressure while controlling the power receiving part to extend and engage with the driving head.

According to the present invention, after the scheme is utilized, a new developing cartridge driving structure is realized, the structure is simple, power transmission is stable, and the technical problem that a power receiving part in a process cartridge cannot normally disengage from and engage with a driving head in an imaging device in the prior art is solved.

The above description is only an overview of the technical scheme of the present invention. In order to better understand the technical means of the present invention, it can be implemented according to the contents of the description. In order to make the above and other objects, features and advantages of the present invention more obvious and understandable, the following is a detailed description of the preferred embodiments with reference to the accompanying drawings.

BRIEF DESCRIPTION OF THE DRAWINGS

In order to more clearly explain the embodiments of the present invention or the technical scheme in the prior art, the following will briefly introduce the drawings needed in the description of the embodiments or the prior art. Obviously, the drawings in the following description are some embodiments of the present invention. For those of ordinary skilled in the art, other drawings can be obtained according to these drawings without creative labor.

The accompanying drawings illustrate one or more embodiments of the present invention and, together with the written description, serve to explain the principles of the invention. Wherever possible, the same reference numbers are used throughout the drawings to refer to the same or like elements of an embodiment.

DETAILED DESCRIPTION

Hereinafter, embodiments of the present invention will be described in detail with reference to the accompanying drawings. It should be understood that the specific embodiments described herein are only used to illustrate the present invention and are not configured to limit the present invention.

First Embodiment

Figure 1:
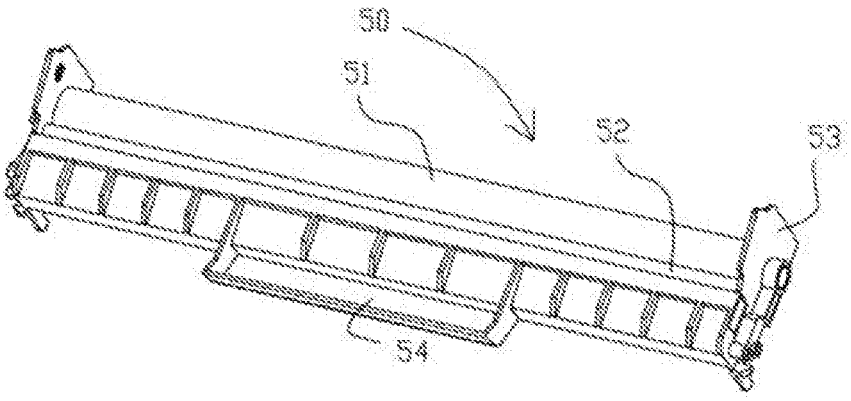
FIG. 1 is a structural diagram of a process cartridge provided by the present invention.

As shown in FIG. 1, a photosensitive cartridge 50 comprises an image bearing member 51, a charging member 52, and a photosensitive cartridge frame 53 supporting the image bearing member 51 and the charging member 52, and a photosensitive cartridge handle 54 is arranged on the photosensitive cartridge frame 53. The charging member 52 is used to charge the image bearing member 51, and the photosensitive cartridge handle 54 is arranged so that a user can grasp the photosensitive cartridge handle 54 to install the photosensitive cartridge 50 into or remove the photosensitive cartridge 50 from an imaging device.

Figure 2:
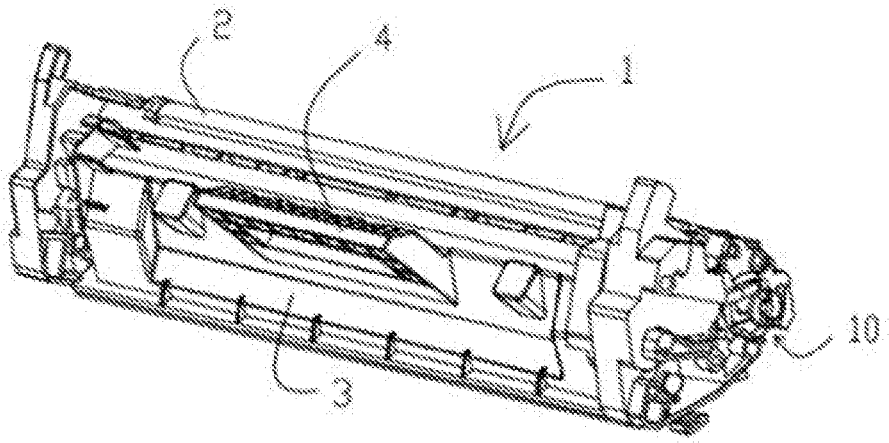
FIG. 2 is an exploded structural diagram of a process cartridge control mechanism provided by the present invention.
Figure 3:
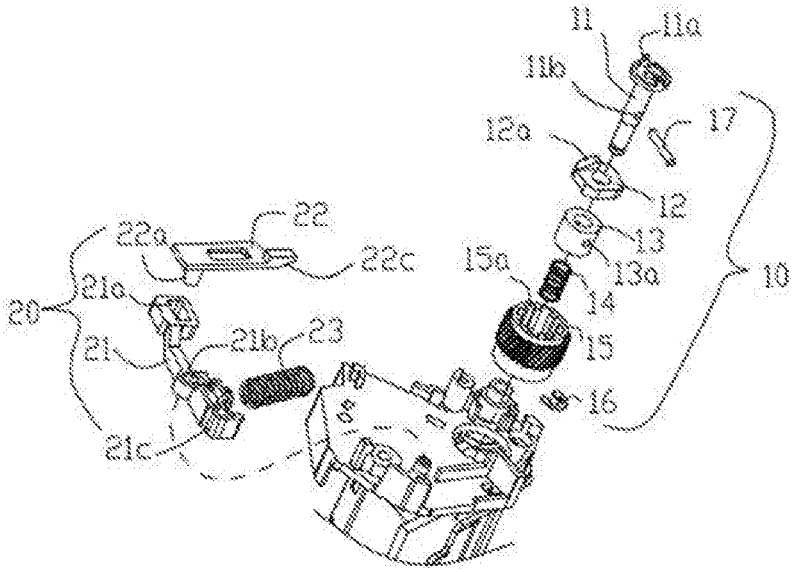
FIG. 3 is an exploded structural diagram of a driving force receiving assembly in a process cartridge provided by the present invention.
Figure 4:
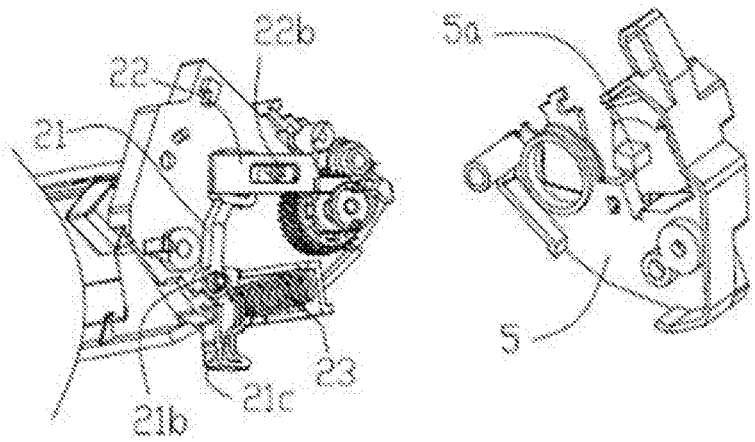
FIG. 4 is a structural diagram of a driving force receiving assembly in a process cartridge provided by the present invention.
Figure 5:
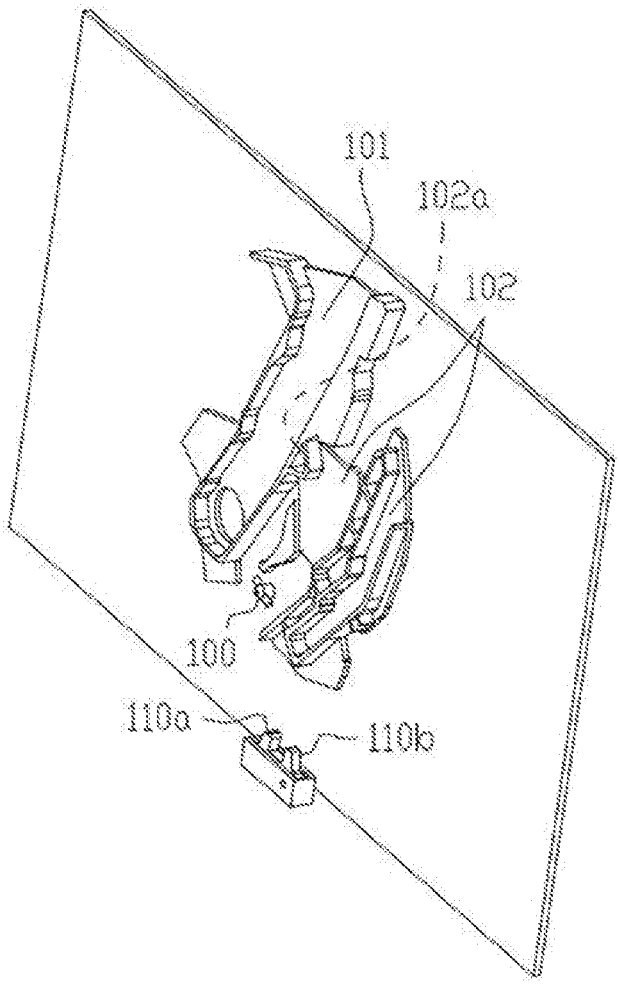
FIG. 5 is a partial structural diagram of a driving force receiving assembly in a process cartridge provided by the present invention.
Figure 6:
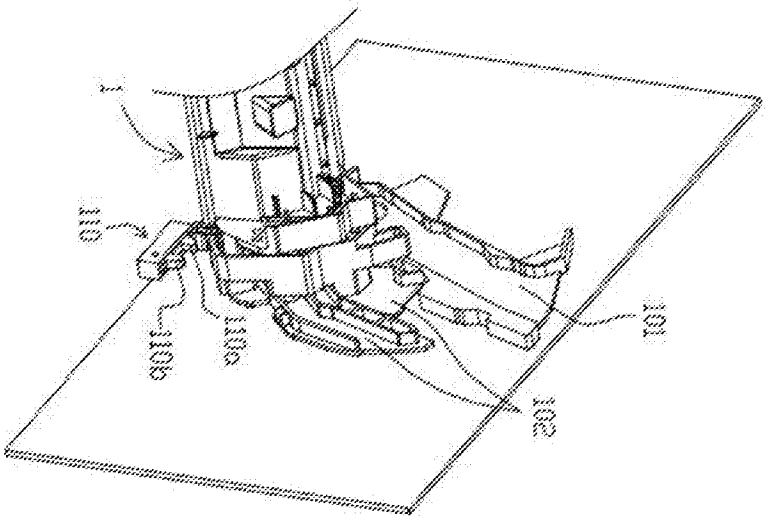
FIG. 6 is a structural diagram of a process cartridge provided by the present invention during installation.
Figure 7:
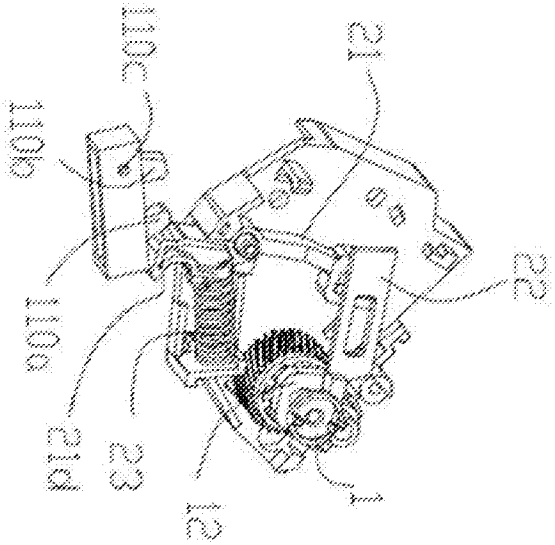
FIG. 7 is a structural diagram of a driving force receiving assembly in a process cartridge provided by the present invention during installation.
Figure 8:
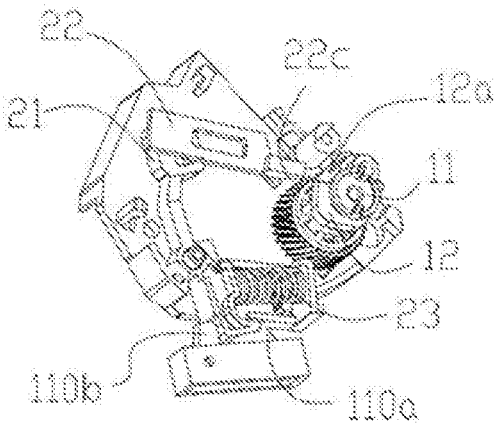
FIG. 8 is a structural diagram of a driving force receiving assembly in a process cartridge provided by the present invention in a first state.

As shown in FIGS. 2 to 4, a developing cartridge 1 comprises a developer bearing member 2, a developing cartridge frame 3 supporting the developer bearing member 2, and a developing cartridge handle 4 arranged on the developing cartridge frame 3. The user can grasp the developing cartridge handle 4 to install the developing cartridge 1 into or remove the developing cartridge 1 from the imaging device. One side of the developing cartridge frame 3 is provided with a driving force receiving assembly 10 for engaging with a driving head 100 (see FIG. 5) in the imaging device to receive a driving force of the driving head 100 in the imaging device.

The driving force receiving assembly 10 of the developing cartridge 1 comprises a power receiving part 11, a pressing block 12, a power transmitting part 13, a first elastic member 14, a gear part 15, a restricting member 16, and a bolt 17. The driving force receiving assembly 10 receives a driving force from the imaging device and drives the developer bearing member 2 in the developing cartridge 1 to rotate. For convenience of explanation, the rotation axis direction of the developer bearing member is referred to as a first direction. The power receiving part 11 is provided with a receiving claw part 11*a* which protrudes substantially in the first direction, the receiving claw part 11*a* can engage with the driving head 100 (see FIG. 5) in the imaging device to receive a driving force of the driving head 100, and the power transmitting part 13 transmits the driving force to the gear part 15. The first elastic member 14 is disposed between the gear part 15 and the power receiving part 11, and the first elastic member 14 provides an elastic force to control the extension and retraction of the power receiving part 11 in the first direction. The power transmitting part 13 is provided with a first bolt hole 13*a*, the power receiving part 11 is provided with a second bolt hole 11*b*, the bolt 17 penetrates through the first bolt hole 13*a* and the second bolt hole 11*b* to fix the power receiving part 11, the gear part 15 is provided with a groove 15*a*, and the groove 15*a* is matched with the bolt 17 to receive the driving force from the power receiving part 11. The restricting member 16 is set to prevent the power receiving part 11 from disengaging from the gear part 15. In this embodiment, a compression spring is utilized for the first elastic member 14, and other elastic materials such as elastic plastic and elastic metal sheets may be used instead. A clamp spring is utilized for the restricting member 16, which is clamped onto the power transmitting part 13, or other restricting means may be utilized, such as making a part, protruding out of the gear part 15, of the power transmitting part 11 into a clip form.

The developing cartridge 1 further comprises a control mechanism 20 which controls the extension and retraction of the driving force receiving assembly 10. The control mechanism 20 comprises a force receiving member 21, a link 22, and a second elastic member 23. One end of the link 22 is provided with a first connecting part 22*a*, and the force receiving member 21 is provided with a second connecting part 21*a* matched with the first connecting part 22*a*. One end of the second elastic member 23 abuts against the developing cartridge frame 3, and the other end abuts against the force receiving member 21. The force receiving member 21 has a rotation center 21*b* and a second stressed part 21*c*, and the force receiving member 21 can rotate around the rotation center 21*b* when an external force acts on the second stressed part 21*c*. In order to make the rotation of the force receiving member 21 smoother, in this embodiment, the second stressed part 21*c* and the second connecting part 21*a* are arranged on two sides of the rotation center 21*b* respectively. In this embodiment, the first connecting part 22*a* is specifically arranged in a protruding clip shape, and the second connecting part 21*a* is arranged in an elongated hole shape matched with the connecting part 22*a*. This structure can stably connect the force receiving member 21 and the link 22. Alternatively, the first connecting part 22*a* and the second connecting part 21*a* can also adopt a combination mode, for example, two convex ribs are arranged on the link 22, and one end of the force receiving member 21 can be directly inserted into the two convex ribs to enable the force receiving member to drive the link to move, and any structure capable of realizing force transmission can achieve the above effect. Looking from a side where the driving force receiving assembly 10 of the developing cartridge 1 is located to the other side in the first direction, when the second stressed part 21*c* does not receive an external force, the second elastic member 23 pushes, by its own elastic force, the force receiving member 21 to rotate clockwise around the rotation center 21*b*, and the force receiving member 21 pushes the first connecting part 22*a* through the second connecting part 21*a* to drive the link 22 to move towards the pressing block 12. A pressing part 22*c* presses a pressed part 12*a* to drive the pressing block 12 to move in a retracting direction of the power receiving part 11. In the retracting process, the pressing block 12 presses the power transmitting part 13, and the power transmitting part 13 drives the power receiving part 11 to retract through the bolt 17.

The link 22 is further provided with a guiding hole 22*b* and the pressing part 22*c*. The developing cartridge 1 further comprises a protecting cover 5 arranged on one side of the driving force receiving assembly 10, the protecting cover 5 is provided with a guiding block 5*a*, and the pressing block 12 is provided with the pressed part 12*a*. The link 22 moves towards the pressing block 12 along the guiding block 5*a* through the guiding hole 22*b*.

As shown in FIGS. 5-8, a first rail 101 guiding the mounting of the photosensitive cartridge 50 and a second rail 102 guiding the mounting of the developing cartridge 1 are arranged in the imaging device. The second rail 102 is movable, and specifically, the second rail can rotate around a fulcrum 102*a*. The first rail 101 is disposed above the second rail 102. When the photosensitive cartridge 50 is mounted on the first rail 101 and the developing cartridge 1 is mounted on the second rail 102, the photosensitive cartridge 50 will be located on the upper side of the developing cartridge 1. A force applying assembly 110 is further arranged in the imaging device, and the force applying assembly 110 is arranged below the first rail 101 and the second rail 102. The force applying assembly 110 comprises a first force applying part 110*a* and a second force applying part 110*b*, the first force applying part 110*a* and the second force applying part 110*b* are spaced apart from each other, and the first force applying part 110*a* is arranged to be rotatable about an axis 110*c*.

After the developing cartridge 1 and the photosensitive cartridge 50 are installed in the imaging device, the imaging device controls the first force applying part 110*a* and the second force applying part 110*b* to move towards the force receiving member 21 in a second direction, the first force applying part 110*a* is pressed by the force receiving member 21 while passing through the force receiving member 21 to rotate downwards past the force receiving member 21, and thereafter, the second force applying part 110*b* presses the second stressed part 21*c* on the force receiving member 21; the force receiving member 21 rotates counterclockwise around the rotation center 21*b*, the force receiving member 21 drives the link 22 to move in a direction away from the pressing block 12, the pressing part 22 releases the pressing of the pressed part 12*a*, and the pressing block 12 stops pressing the power transmitting part 13 accordingly; and the power receiving part 11 protrudes outwards in the first direction under the elastic force of the first elastic member 14 and engages with the driving head 100 in the imaging device to receive the driving force of the driving head 100. Meanwhile, since the force receiving member is pressed by the second force applying part 110*b*, the second elastic member 23 will provide an urging force to allow the developer bearing member 2 in the developing cartridge 1 to make contact with the image bearing member 51 in the photosensitive cartridge at a predetermined pressure, therefore, the force receiving member 21 and the second elastic member also have an effect of urging the developer bearing member 2 to make contact with the image bearing member 51 at a certain pressure so as to complete development.

When printing is completed, the imaging device controls the first force applying part 110*a* and the second force applying part 110*b* to move away from the force receiving member 21, the second force applying part 110*b* releases the pressing of the second stressed part 21*c*, the second elastic member 23 pushes, by its own elastic force, the force receiving member 21 to rotate clockwise around the rotation center 21*b*, and the force receiving member 21 pushes the first connecting part 22*a* through the second connecting part 21*a* to drive the link 22 to move towards the pressing block 12. The pressing part 22*c* presses the pressed part 12*a* to drive the pressing block 12 to move in the retracting direction of the power receiving part 11, the pressing block 12 presses the power transmitting part 13 in the retracting process, and the power transmitting part 13 drives the power receiving part 11 to retract through the bolt 17 so as to disengage from the driving head 100 in the imaging device.

The force receiving member 21 is further provided with a first stressed part 21*d* matched with the first force applying part 110*a*. The first stressed part 21*d* receives the force of the first force applying part 110*a* to drive the developing cartridge 1 to move so that the developer bearing member 2 is out of contact with the image bearing member 51, so as to prevent the developer bearing member 2 from contaminating the image bearing member 51.

Figure 9:
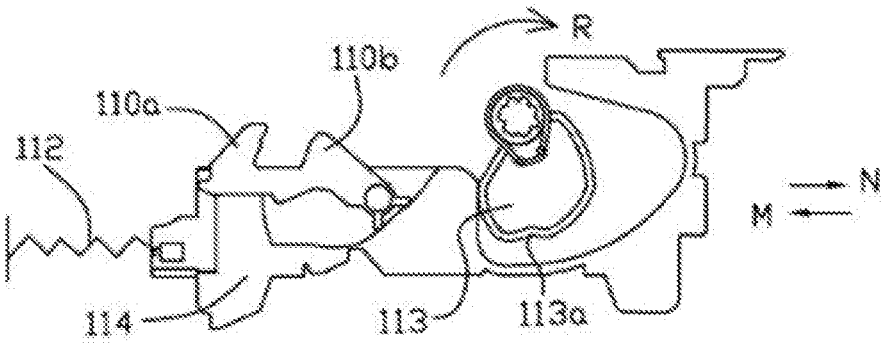
FIGS. 9 to 11 are structural diagrams of a control rail in an imaging device according to an embodiment of the present invention.
Figure 10:
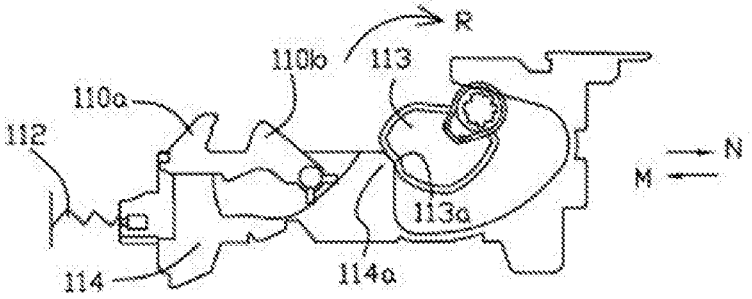
Figure 11:
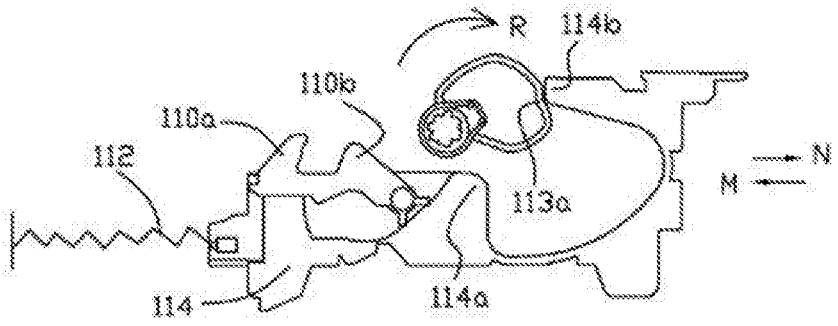

As shown in FIGS. 9-11, a control rail for controlling the movement of the force applying assembly 110 in the imaging device comprises a moving block 114 connected with the force applying assembly 110, and a cam 113 is matched with the moving block 114 to control the movement of the moving block 114. For convenience of explanation, the moving direction of the moving block 114 from left to right is referred to as an N direction, the moving direction of the moving block 114 from right to left is referred to as an M direction, and the cam 113 rotates in a clockwise direction R. The cam 113 drives the moving block 114 to reciprocate in the M direction and the N direction by rotating in the R direction. The cam 113 is provided with an abutting part 113*a*, and the moving block 114 is provided with a first abutted part 114*a* and a second abutted part 114*b*. When the first abutted part 114*a* abuts against the abutting part 113*a*, the moving block 114 is positioned at a left position, and when the second abutted part 114*b* abuts against the abutting part 113*a*, the moving block 114 is positioned at a right position. One end of the moving block 114 is connected with an inner wall of the imaging device through a first spring 112 which provides an elastic force to pull the moving block 114 leftwards.

Figure 12:
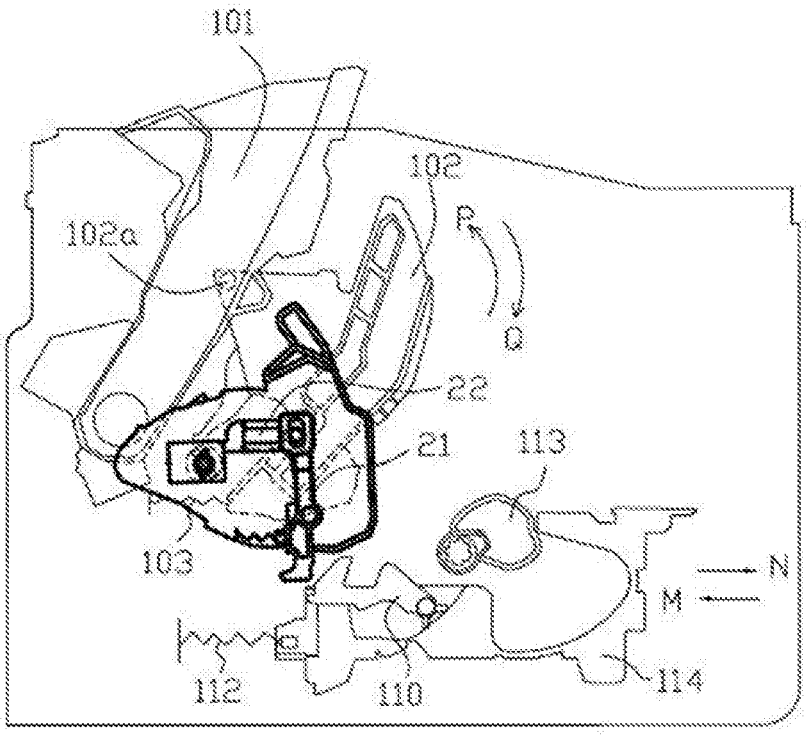
FIGS. 12 to 15 are structural diagrams of various states of a developing cartridge in an imaging device in an embodiment of the present invention.
Figure 13:
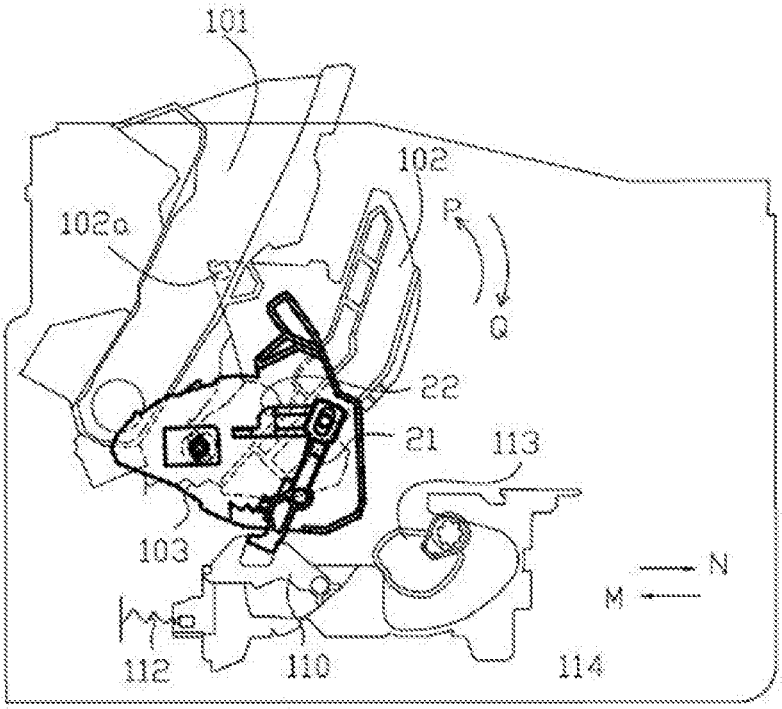
Figure 14:
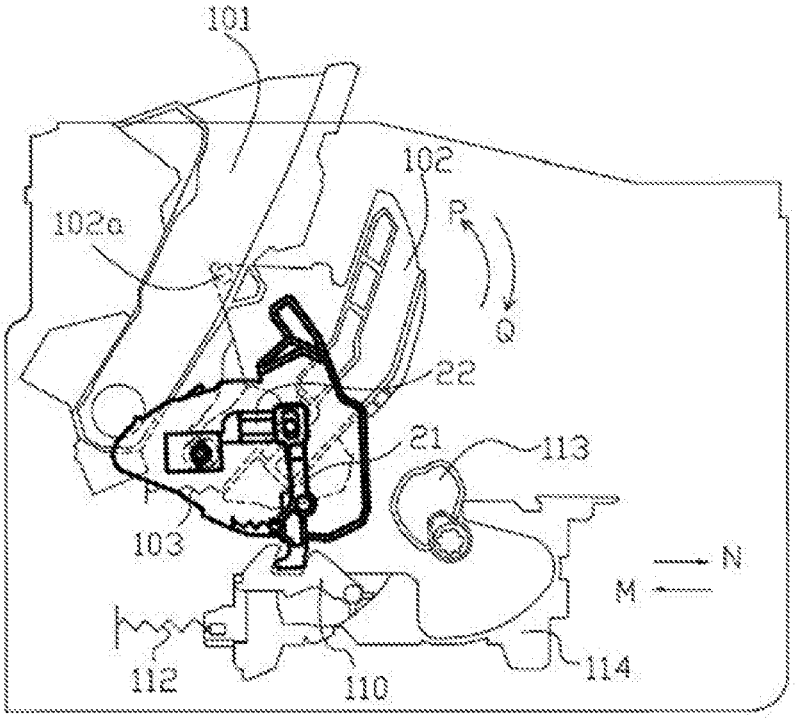
Figure 15:
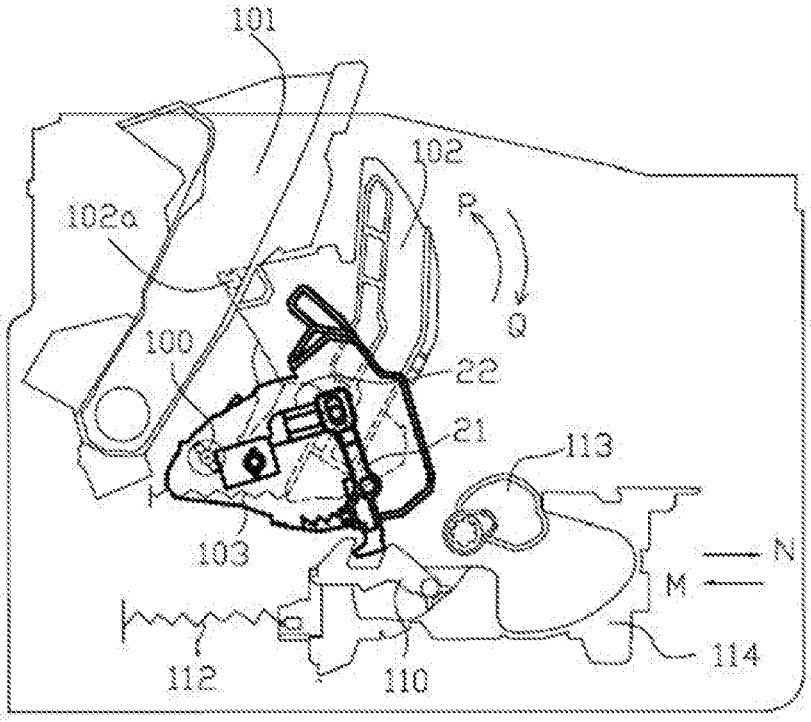

As shown in FIG. 12, the second rail 102 and the inner wall of the imaging device are connected by a second spring 103, and the second rail 102 can rotate in a clockwise direction Q and a counterclockwise direction P around the fulcrum 102*a*. The second spring 103 provides an elastic force to pull the second rail 102 counterclockwise.

As shown in FIGS. 12-15, when the developing cartridge 1 is installed in the imaging device, the imaging device runs and drives the cam 113 to rotate in the R direction, the abutting part 113*a* releases the abutting to the second abutted part 114*b*, the moving block 114 moves leftwards in the M direction under the elastic force of the first spring 112, and the cam 113 continues to rotate in the R direction to a position where the abutting part 113*a* abuts against the first abutted part 114*a*; and in this process, the first force applying part 110*a* passes over the first stressed part 21*c* and the second stressed part 21*b*, and the second force applying part 110*b* urges the force receiving member 21 so that the power receiving part 11 extends out to engage with the driving head 100 in the imaging device. When printing is finished, the imaging device controls the cam 113 to continue to rotate in the R direction, the cam 113 abuts against the second abutted part 114*b* to force the moving block 114 to move rightwards in the N direction against the elastic force of the first spring 112, and the second force applying part 110*b* in the force applying assembly 110 pulls the second stressed part 21*d* of the force receiving member 21 to make the power receiving part 11 retract and disengage from the driving head 100; and the cam 113 continues to rotate to drive the moving block 114 to continue to move rightwards in the N direction, finally, the abutting part 113*a* of the cam 113 abuts against the second abutted part 114*b* of the moving block 114, and the second force applying part 110*b* pulls the developing cartridge 1 through the force receiving member 21 so that a developing roller 2 in the developing cartridge 1 is out of contact with the image bearing member 51 in the photosensitive cartridge 50.

Second Embodiment

According to the second embodiment of the present invention, the control mechanism 20 for controlling the extension and retraction of the power receiving part 11 is arranged on the other side of the developing cartridge 1 opposite to the power receiving part 11, the power receiving part 11 is connected to a long shaft penetrating through the developing cartridge frame 3, the control mechanism 20 controls the extension and retraction of the long shaft on the opposite side of the power receiving part 11, and then the long shaft is utilized to drive the extension and retraction of the power receiving part 11. This arrangement can avoid the disadvantage that too many structures are arranged on the same side of the power receiving part 11 to cause the space occupied by the developing cartridge 1 on one side of the power receiving part 11 to become large, which finally makes the volume occupied by the imaging device become large.

Third Embodiment

Figure 16:
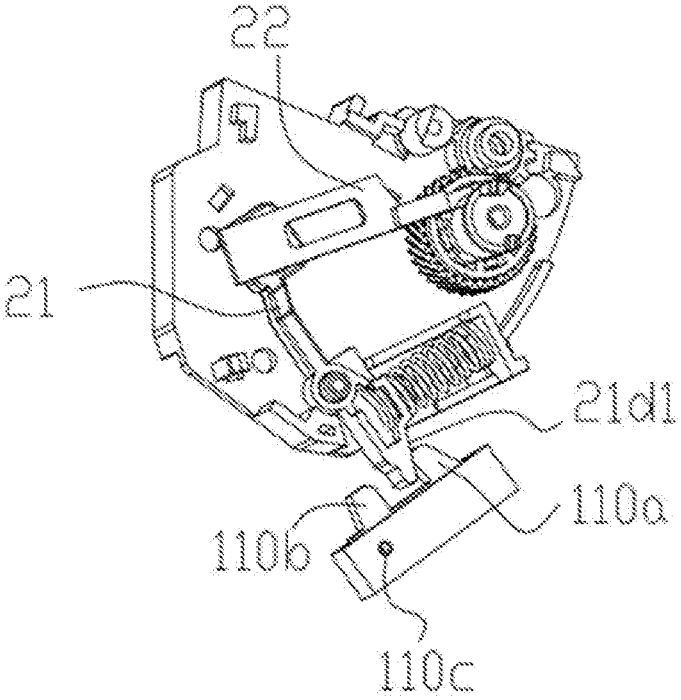
FIG. 16 is a structural diagram of a driving force receiving assembly in a process cartridge provided by the present invention in a second state.

The third embodiment of the present invention is shown as FIG. 16, wherein the first stressed part 21*d* has a different structure, referred to herein as a third stressed part 21*d*1; when the first force applying part 110*a* moves away from the developing cartridge 1, the third stressed part 21*d*1 presses the first force applying part 110*a* to make it rotate around the axis 110*c* without driving the developing cartridge 1 to move; specifically, a place where the third stressed part 21*d*1 makes contact with the first force applying part 110*a* is arranged to be inclined in different directions, so that the third stressed part 21*d*1 and the developing cartridge 1 with this configuration will no longer move with the first force applying part 110*a* to avoid the disadvantage that the power receiving part 11 repeatedly rubs with the driving head 100 in the imaging device during the repeated movement of the developing cartridge 1, which finally shortens the service life of the power receiving part 11 and the driving head 11.

Fourth Embodiment

Figure 17:
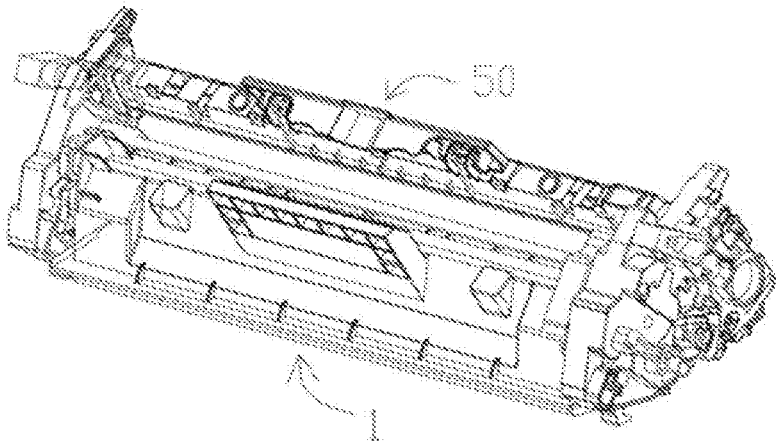
FIG. 17 is a structural diagram of a process cartridge provided by the present invention as an integrated cartridge.
Figure 18:
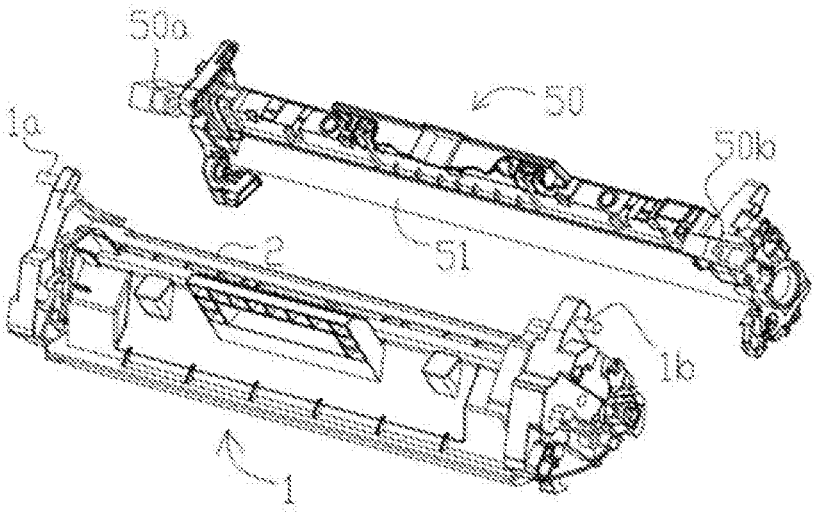
FIG. 18 is an exploded view of a process cartridge provided by the present invention as an integrated cartridge.

The fourth embodiment of the present invention is shown as FIGS. 17 and 18, wherein the developing cartridge 1 and the photosensitive cartridge 50 can also be made into an integrated process cartridge structure, the developing cartridge 1 is provided with a pair of mounting shafts 1*a* and 1*b*, the photosensitive cartridge 50 is provided with a pair of shaft mounting holes 50*a* and 50*b*, the photosensitive cartridge 50 and the developing cartridge 1 are integrally mounted in the imaging device, and the developing cartridge 1 rotates around the photosensitive cartridge 50 with the pair of mounting shafts 1*a* and 1*b* as a rotation center. The force receiving member arranged in the developing cartridge 1 and the force applying assembly in the imaging device cooperate to complete switching between a contact state and a separation state of the developer bearing member 2 in the developing cartridge 1 and the image bearing member 51 in the photosensitive cartridge 50. Due to the mounting shafts 1*a* and 1*b*, the relative rotational positions of the developing cartridge 1 and the photosensitive cartridge 50 are more accurate in each separation and contact process of the developer bearing member 2 in the developing cartridge 1 and the image bearing member 51 in the photosensitive cartridge 50, thus ensuring the accurate contact between the developer bearing member 2 and the image bearing member 51 and improving the development imaging effect.

Fifth Embodiment

Figure 19:
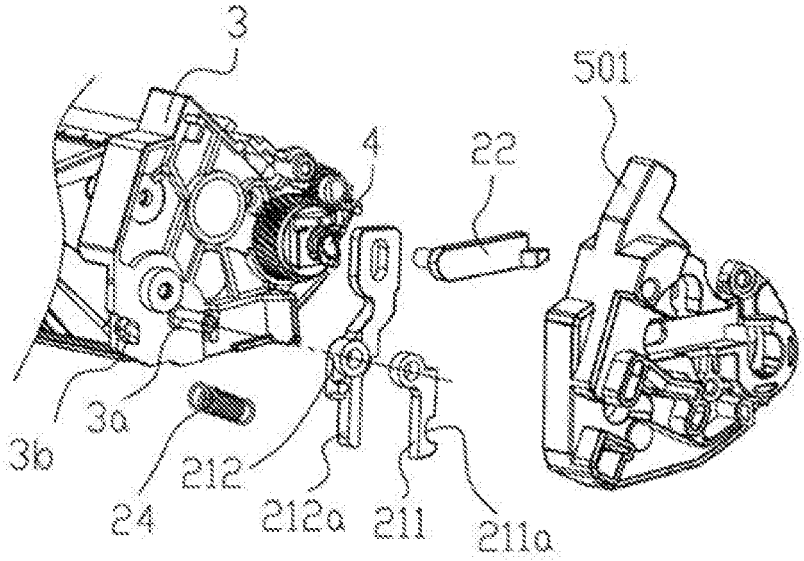
FIGS. 19 and 20 are exploded structural diagrams of a control mechanism in a process cartridge according to a fifth embodiment of the present invention.
Figure 20:
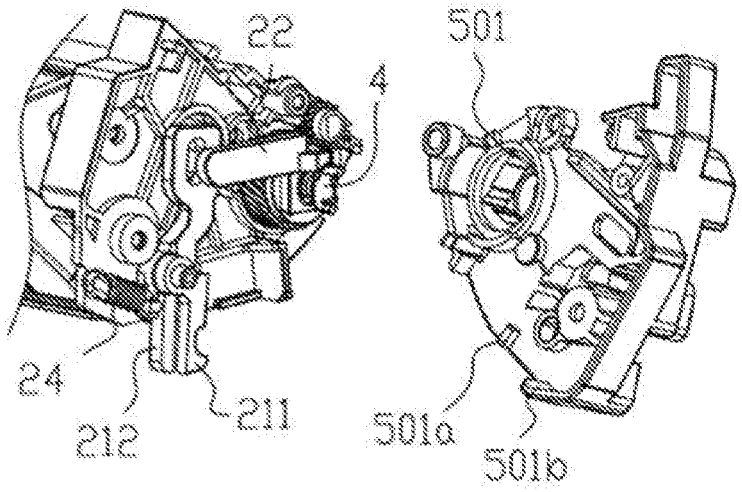

The fifth embodiment of the present invention is shown as FIGS. 19 and 20, wherein the driving force receiving assembly in this embodiment is the same as that in the first embodiment; and the difference of this embodiment is that the force receiving member in this embodiment is divided into a first force receiving member 212 and a second force receiving member 211, the first force receiving member 212 and the second force receiving member 211 are coaxially mounted on a mounting post 3*a* of the frame 3, the second force receiving member 211 is provided with a first elastic member receiving part 211*a*, the frame 3 is provided with a second elastic member receiving part 3*b*, one end of an elastic member 24 is connected with the first elastic member receiving part 212*a* and the other end is connected with the second elastic member receiving part 3*b*, the first force receiving member 212 can rotate around the mounting post 3*a* under the elastic force of the elastic member 24, and the first force receiving member 212 is provided with a first stressed part 212*a* which can receive the force of the first force applying part 110*b*. The second force receiving member 211 and the first force receiving member are arranged to rotate freely, the second force receiving member 211 is provided with a second stressed part 211*a* capable of receiving the force of the second force applying part 110*a*, and the protecting cover 5 is provided with a first limiting part 501*a* and a second limiting part 502*b*; the first limiting part 501*a* is arranged to prevent the second force receiving member 211 from rotating excessively towards the power receiving part 4, causing a failure in engaging with the second force applying part 110*a*; and the second limiting part 501*b* is arranged so that when the second force applying part 110*a* pulls the second force receiving member 211 to rotate, the second force receiving member 211 drives the developing cartridge to rotate by being blocked by the second limiting part 501*b*.

The developing cartridge is in an unmounted state, the elastic force of the elastic member 24 pulls the first force receiving member 212 to rotate around the mounting post 3*a*, the first force receiving member 212 drives the link 22 to move and presses the pressing block to retract so that the power receiving part 4 is in a retraction state, and the developing cartridge can be smoothly mounted in the imaging device without interfering with the driving head in the imaging device. When the developing cartridge is installed in the imaging device, the imaging device controls the first force applying part 110*b* to push the first stressed part 212*a* on the first force receiving member 212 so that the first force receiving member 212 rotates against the elastic force of the elastic member 24, the rotation of the first force receiving member 212 drives the link 22 to move and releases a pressing force on the pressing block, the power receiving part 4 extends out to engage with the driving head in the imaging device, and the elastic force of the elastic member 24 causes the developer bearing member in the developing cartridge to make contact with the image bearing member at a certain pressure so as to realize imaging well. When printing is completed, the imaging device controls the second force applying part 110*a* to pull the second force receiving member 211 to drive the developing cartridge to move away from the photosensitive cartridge, and the developer bearing member in the developing cartridge is separated from the image bearing member in the photosensitive drum cartridge; meanwhile, the elastic force of the elastic member 24 pulls the first force receiving member 212 to rotate around the mounting post 3*a*, and the first force receiving member 212 drives the link 22 to move and presses the pressing block, so that the power receiving part 4 is in a retraction state to ensure that the power receiving part 4 in the developing cartridge smoothly disengages from the driving head in the imaging device without affecting the movement of the developing cartridge.

In this embodiment, a tension spring is preferably used as a specific structure of the elastic member. Alternatively, other elastomer structures such as a compression spring or a torsion spring may be used. Through appropriate structural design, the elastic force of the elastomer such as the tension spring, the compression spring or the torsion spring can be used to allow the developer bearing member and the image bearing member to make contact at a certain pressure to realize imaging well, and besides, the elastic force can be used to control the extension and retraction of the power receiving part. As a preferred scheme, the first force receiving member 212 and the second force receiving member 211 are coaxially mounted on the mounting post 3*a*, which can make the structure more compact and reduce the volume of a developing unit. However, the mounting of the first force receiving member 212 and the second force receiving member 211 on different mounting posts of the frame 3 can also achieve the technical effect of this embodiment. As a preferred embodiment, the second force receiving member 211 is arranged in a freely rotatable manner, so that the second force receiving member 211 and the second force applying part 110*a* can be matched more flexibly and do not disengage easily. Since the second force receiving member 211 does not need to provide a pressure for the developing roller to make contact with a photosensitive drum, the second force receiving member 211 can also be arranged to be unmovable. Specifically, the second force receiving member 211 is restrained from moving by a first positioning part 501*a* and a second positioning part 501*b*, or the second force receiving member 211 is integrally formed with the frame 3 to fix the second force receiving member 211 on the frame, which can achieve the same technical effect of separating the developing roller from the photosensitive drum.

Sixth Embodiment

In this embodiment, components having the same functions and effects as those of the above-mentioned embodiments are given the same names as those of the above-mentioned embodiments, and the descriptions thereof are omitted.

The structure of this embodiment will be described in detail below with reference to the drawings.

Figure 21:
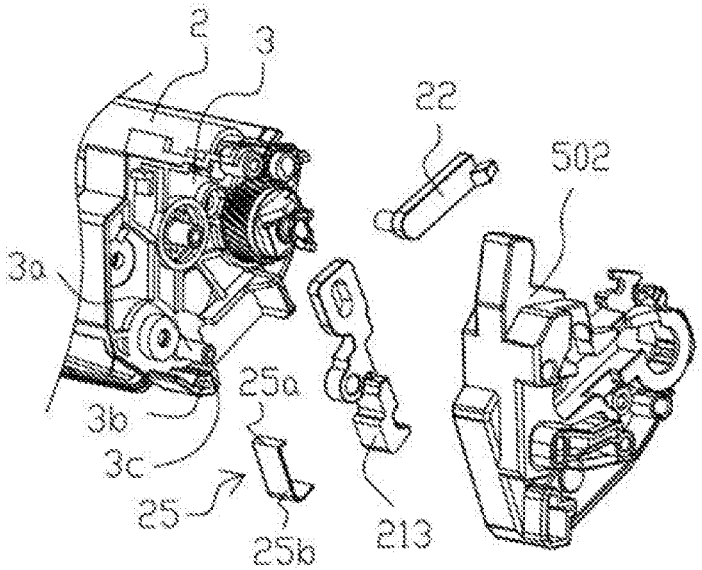
FIG. 21 is an exploded structural diagram of a control mechanism in a process cartridge according to a sixth embodiment of the present invention.
Figure 22:
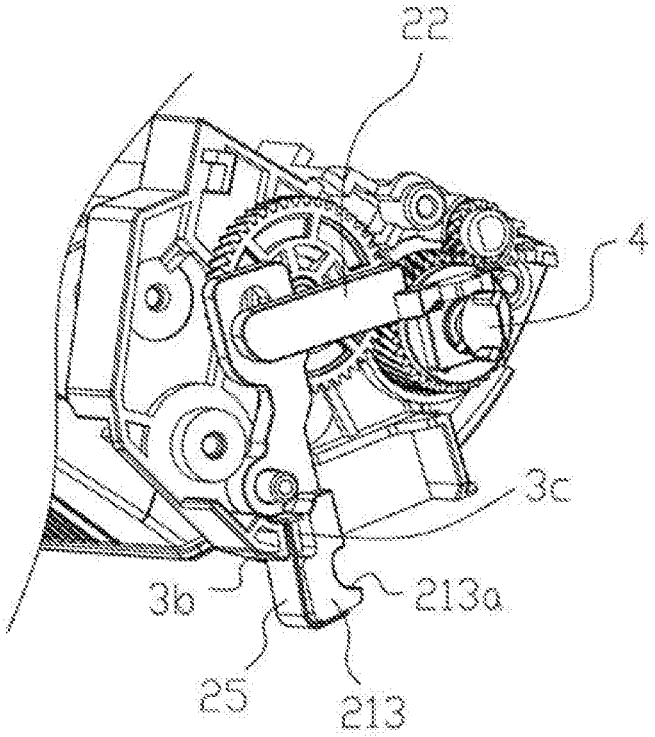
FIG. 22 is a partial structural diagram of a control mechanism in a process cartridge according to a sixth embodiment of the present invention.

As shown in FIGS. 21 and 22, the components of the driving force receiving assembly in this embodiment are the same as those in the first embodiment. The difference of this embodiment is that in this embodiment, the first stressed part 25*b* is arranged on an elastic piece 25, and the frame 3 is provided with a pair of elastic piece mounting parts 3*b* and 3*c*. In this embodiment, the elastic piece 25 is specifically configured as an elastic thin metal sheet structure, an end of the elastic piece 25 opposite to the first stressed part 25*b* is provided with a mounted part 25*a*, and the mounted part 25*a* is mounted in a slit space formed by the pair of elastic piece mounting parts 3*b* and 3*c*. The frame 3 is further provided with a mounting post 3*a* for mounting a force receiving member 213, the force receiving member 213 is disposed adjacent to the elastic piece 25 and is kept connected with one end of the elastic piece 25 away from the mounted part 25*a*, and the force receiving member 213 is provided with a second stressed part 213*a* which can receive the force of the second force applying part 110*b*.

The developing cartridge is in an unmounted state, the elastic force of the elastic piece 25 keeps the first force receiving member 212 in a starting position, the starting position is set such that the first force receiving member 212 presses the pressing block to retract through the link 22 so that the power receiving part 4 is in a retraction state, and the developing cartridge can be smoothly installed in the imaging device without interfering with the driving head in the imaging device. When the developing cartridge is installed in the imaging device, the imaging device controls the second force applying part 110*b* to push the first stressed part 25*b* on the elastic piece 25, and the elastic piece 25 is pressed and elastically deformed. During the elastic deformation of the elastic piece 25, the force receiving member 213 rotates to drive the link 22 to move and release the pressing force on the pressing block, the power receiving part 4 extends out to engage with the driving head in the imaging device, and at the same time, the elastic force of the elastic piece 25 after deformation causes the developer bearing member in the developing cartridge to make contact with the image bearing member at a certain pressure to realize imaging well. When printing is completed, the second force applying part 110*b* drives the developing cartridge to move away from the photosensitive cartridge by pulling the force receiving member 213, the developer bearing member in the developing cartridge is separated from the image bearing member in the photosensitive drum cartridge, and at the same time, when the force receiving member 213 rotates by receiving the force of the second force applying part 110*a*, the force receiving member 213 drives the link 22 to move and presses the pressing block so that the power receiving part 4 is in a retraction state to ensure smooth disengagement of the power receiving part 4 in the developing cartridge from the driving head in the imaging device. In addition, the elastic force of the elastic piece 25 after deformation can further pull the force receiving member 213 to rotate around the mounting post 3*a*, and the force receiving member 213 drives the link 22 to move and presses the pressing block so that the power receiving part 4 is in a retraction state to ensure smooth disengagement of the power receiving part 4 in the developing cartridge from the driving head in the imaging device without affecting the movement of the developing cartridge.

In this embodiment, the elastic piece 25 is disposed on a side of the force receiving member 213 opposite to the power receiving part 4, or the elastic piece 25 may be disposed on the same side of the force receiving member 213 as the power receiving part 4, so that the force receiving member 213 only needs to be disposed close to the elastic piece 25 without additionally providing a connecting part to be connected with the elastic piece 25, further simplifying the structure. The elastic piece 25 may be made of a metal material or a resin material such as silicone rubber, as long as the elastic force provided enables the developing roller to make contact with the photosensitive drum at a certain pressure.

Seventh Embodiment

In this embodiment, components having the same functions and effects as those of the above-mentioned embodiments are given the same names as those of the above-mentioned embodiments, and the descriptions thereof are omitted.

The structure of this embodiment will be described in detail below with reference to the drawings.

Figure 23:
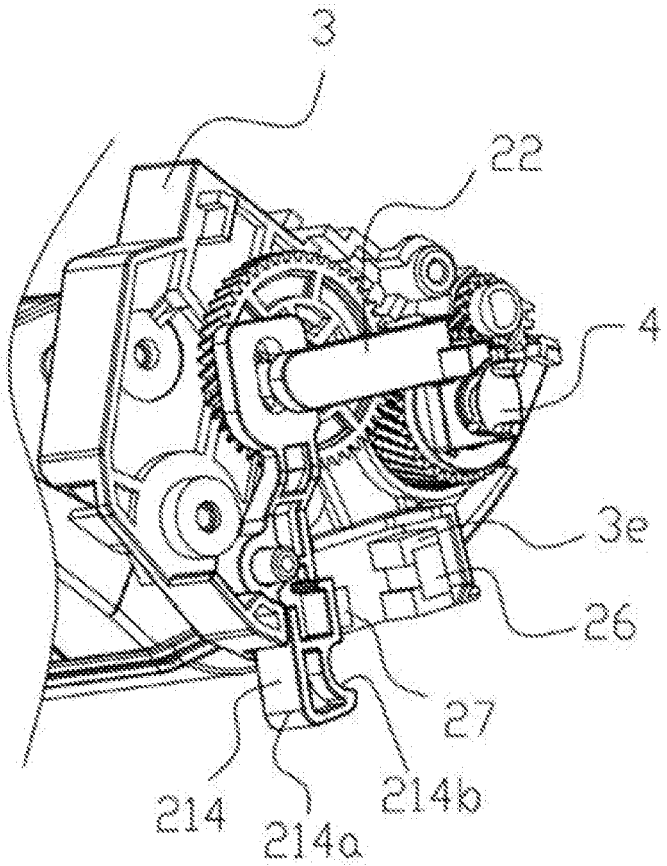
FIG. 23 is a partial structural diagram of a control mechanism in a process cartridge according to a seventh embodiment of the present invention.
Figure 24:
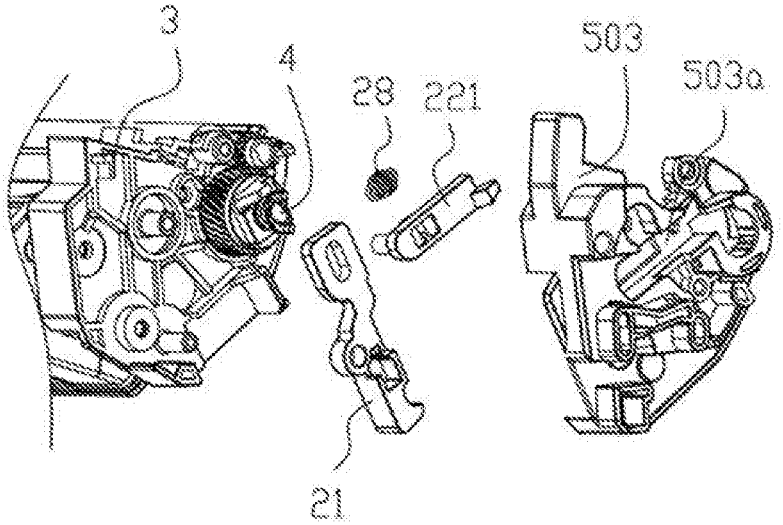
FIG. 24 is an exploded structural diagram of a control mechanism in a process cartridge according to an eighth embodiment of the present invention.
Figure 25:
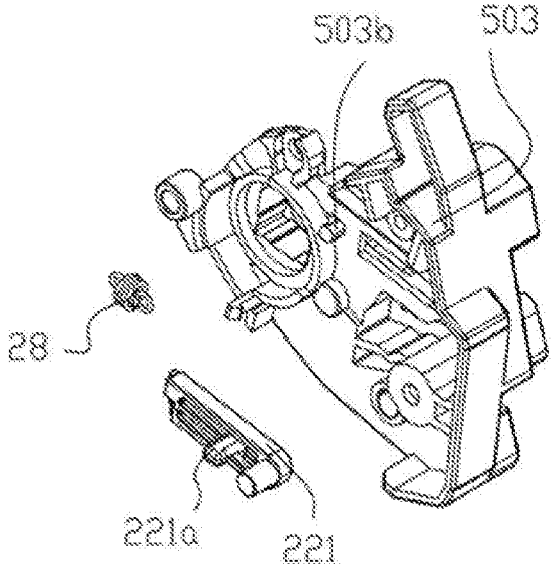
FIG. 25 is an exploded structural diagram of a control mechanism in a process cartridge according to an eighth embodiment of the present invention.
Figure 26:
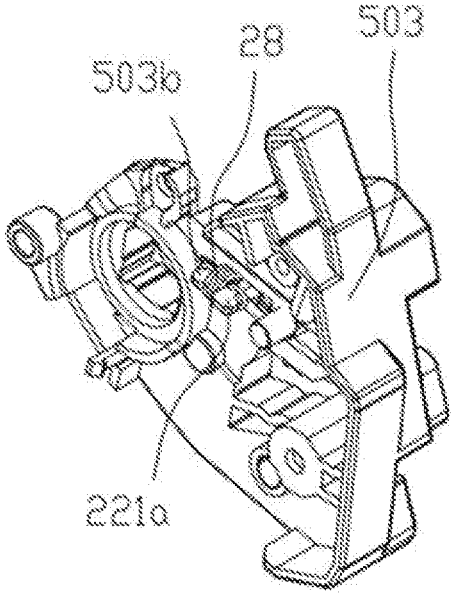
FIG. 26 is a partial exploded structural diagram of a control mechanism in a process cartridge according to an eighth embodiment of the present invention.
Figure 27:
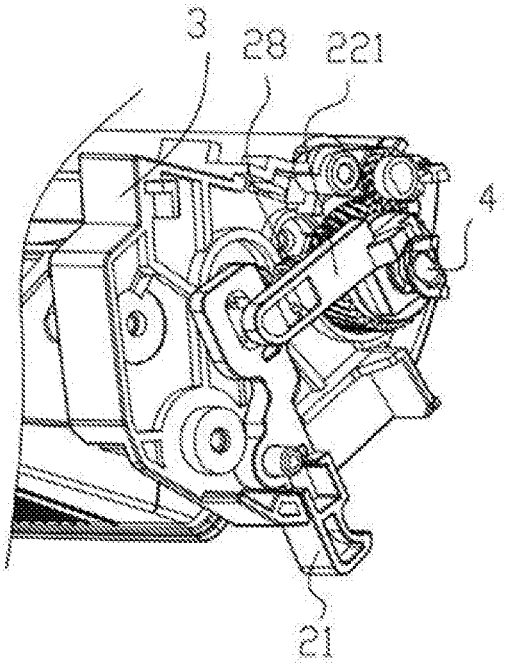
FIG. 27 is a partial structural diagram of a control mechanism in a process cartridge according to an eighth embodiment of the present invention.

As shown in FIG. 23, the components of the driving force receiving assembly in this embodiment are the same as those in the first embodiment, and the difference of this embodiment is that in this embodiment, a magnetic body mounting part 3*e* is arranged on the frame 3, a first magnetic body 26 is mounted in the magnetic body mounting part 3*e*, the force receiving member 214 is provided with a second magnetic body 27, and poles, with the same magnetic pole, of the first magnetic body 26 and the second magnetic body 27 are opposite.

The developing cartridge is in an unmounted state, and under a repulsive force of like magnetic poles of the first magnetic body 26 and the second magnetic body 27, the first force receiving member 212 rotates and drives the link 22 to move to press the pressing block to retract, so that the power receiving part 4 is in a retraction state, and the developing cartridge can be smoothly installed in the imaging device without interfering with the driving head in the imaging device. When the developing cartridge is installed in the imaging device, the imaging device controls the first force applying part 110*b* to push the first stressed part 214*a* on the force receiving member 214 to make the force receiving member 214 rotate, the force receiving member 214 rotates against the repulsive force between the first magnetic body 26 and the second magnetic body 27 and drives the link 22 to move and release the pressing force on the pressing block, and the power receiving part 4 extends out to engage with the driving head in the imaging device; meanwhile, the repulsive force between the first magnetic body 26 and the second magnetic body 27 causes the developer bearing member in the developing cartridge to make contact with the image bearing member at a certain pressure to realize imaging well. When printing is completed, the second force applying part 110*a* drives the force receiving member 214 to move by pulling the second stressed part 214*b* on the force receiving member 214, the force receiving member 214 drives the developing cartridge to move away from the photosensitive cartridge, and the developer bearing member in the developing cartridge is separated from the image bearing member in the photosensitive drum cartridge; meanwhile, when the force receiving member 214 rotates by receiving the force of the second force applying part 110*a*, the force receiving member 214 drives the link 22 to move and presses the pressing block so that the power receiving part 4 is in a retraction state to ensure smooth disengagement of the power receiving part 4 in the developing cartridge from the driving head in the imaging device; in addition, the repulsive force between the first magnetic body 26 and the second magnetic body 27 can further push the force receiving member 214 to rotate, the force receiving member 214 drives the link 22 to move and presses the pressing block so that the power receiving part 4 is in a retraction state to ensure smooth disengagement of the power receiving part 4 in the developing cartridge from the driving head in the imaging device without affecting the movement of the developing cartridge.

Eighth Embodiment

In this embodiment, components having the same functions and effects as those of the above-mentioned embodiments are given the same names as those of the above-mentioned embodiments, and the descriptions thereof are omitted.

The structure of this embodiment will be described in detail below with reference to the drawings.

As shown in FIGS. 24 to 27, the components of the driving force receiving assembly in this embodiment are the same as those in the first embodiment, and the difference of this embodiment is that an elastic member 28 is arranged between the link 221 and the protecting cover 503 in this embodiment, the protecting cover 503 is provided with a guiding chute 503*a* for guiding the sliding of the link 221, and the link 221 is installed in the guiding chute 503*a* from a side of the protecting cover 503 opposite to the frame 3; and the protecting cover 503 is further provided with a first elastic member connecting part 503*b*, a second elastic member connecting part 221*a* is arranged on the link 221, and one end of the elastic member 28 is connected with the first elastic member connecting part 503*b* while the other end is connected with the second elastic member connecting part 221*a*.

The developing cartridge is in an unmounted state, the elastic force of the elastic member 28 pulls the link 22 to move and presses the pressing block to retract so that the power receiving part 4 is in a retraction state, and the developing cartridge can be smoothly mounted in the imaging device without interfering with the driving head in the imaging device. When the developing cartridge is installed in the imaging device, the imaging device controls the first force applying part 110*b* to push the force receiving member 21, the force receiving member 21 is pushed by the first force applying part 110*b* to rotate and drive the link 221 to move, the link 221 moves against the elastic force of the elastic member 28 and releases a pressing force on the pressing block, the power receiving part 4 extends out to engage with the driving head in the imaging device, and the elastic force of the elastic member 28 after deformation causes the developer bearing member in the developing cartridge to make contact with the image bearing member at a certain pressure to realize imaging well. When printing is completed, the second force applying part 110*a* drives the developing cartridge to move away from the photosensitive cartridge by pulling the force receiving member 21, and the developer bearing member in the developing cartridge is separated from the image bearing member in the photosensitive drum cartridge; meanwhile, when the force receiving member 21 rotates by receiving the force of the second force applying part 110*a*, the force receiving member 21 drives the link 22 to move and presses the pressing block so that the power receiving part 4 is in a retraction state to ensure smooth disengagement of the power receiving part 4 in the developing cartridge from the driving head in the imaging device; in addition, the elastic force of the elastic member 28 can further pull the link 221 to move and press the pressing block so that the power receiving part 4 is in a retraction state to ensure smooth disengagement of the power receiving part 4 in the developing cartridge from the driving head in the imaging device without affecting the movement of the developing cartridge.

In this embodiment, the elastic member 28 may also be disposed between the link 221 and the frame 3, and specifically, one end of the elastic member 28 is connected to the frame and the other end is connected to the link 221, which can also achieve the technical effect of controlling the extension and retraction of the power receiving part and urging the developer bearing member to make contact with the image bearing member at a certain pressure. In this embodiment, the elastic member is preferably a tension spring, and other elastomer structures such as a compression springs or a torsion spring can also be utilized as long as the elastomer can control the movement of the link 221.

In the above embodiments, the force receiving member preferably controls the movement of the link in a rotating manner. Alternatively, the force receiving member may also control the movement of the link in a sliding manner. Setting the force receiving member and the link separately as a preferred scheme can make the control mechanism more flexible, and the force receiving member and the link may also be made into an integrated structure, which can also achieve the technical effects of controlling the extension and retraction of the power receiving part and urging the developer bearing member to make contact with the image bearing member at a certain pressure. One of ordinary skilled in the art should understand that the frame 3 should comprise the protecting cover 5, and a movable part, an elastic piece, a separating part and other components can be installed on any part of the frame 3 comprising the protecting cover 5.

Ninth Embodiment

Figure 28:
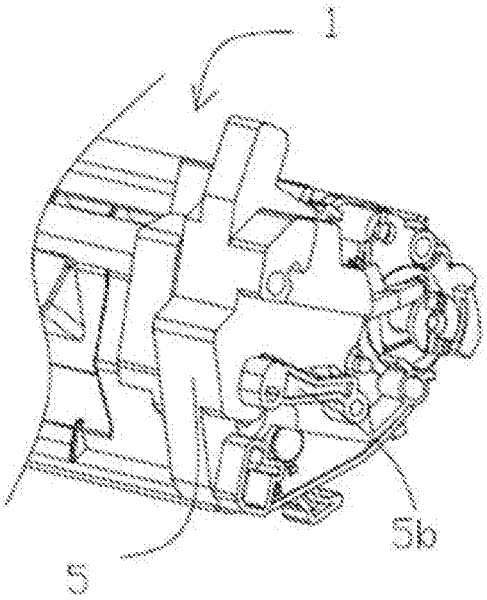
FIG. 28 is a structural diagram of a process cartridge driving side according to a ninth embodiment of the present invention.
Figure 29:
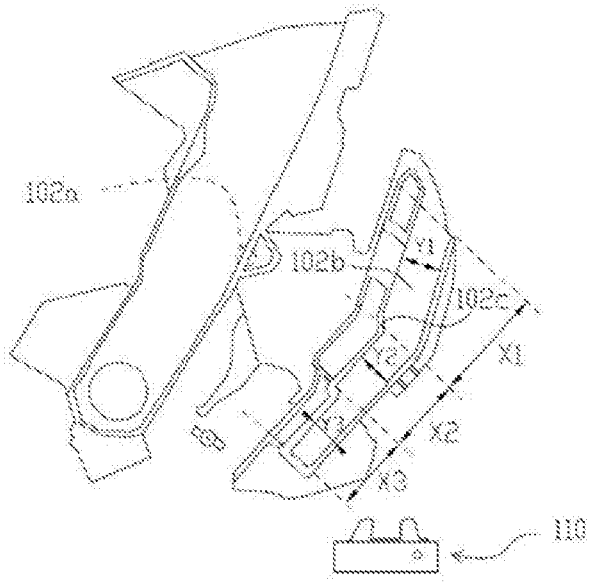
FIG. 29 is a partial structural diagram of a rail in an imaging device according to a ninth embodiment of the present invention.

The ninth embodiment of the present invention is shown as FIGS. 28 to 32. As shown in FIGS. 28 and 29, the protecting cover 5 of the developing cartridge 1 is provided with a support projection 5*b*, the second rail 102 in the imaging device comprises a positioning rail 102*b*, the support projection 5*b* can slide along the second rail 102 in the imaging device, and the second rail 102 is configured to position the support projection 5*b* in the imaging device. In order to mount and position the developing cartridge 1 more conveniently, the second rail 102*b* is roughly divided into three virtual areas in a mounting direction of the developing cartridge 1, namely a first virtual area X1, a second virtual area X2, and a third virtual area X3. Along the mounting direction of the developing cartridge 1, the second virtual area X2 is downstream of the first virtual area X1, and the third virtual area X3 is downstream of the second virtual area X2. The width of the first virtual area X1 is Y1, the width of the second virtual area X2 is Y2, the width of the third virtual area X3 is Y3, and the sizes of Y1, Y2 and Y3 meet the following relational expression: Y1>Y2>Y3. Due to the fact that the width of the positioning rail 102*b* decreases step by step from the upstream side to the downstream side in the mounting direction of the developing cartridge 1, the developing cartridge 1 can be conveniently mounted from the upstream side and positioned at the downstream side.

Figure 30:
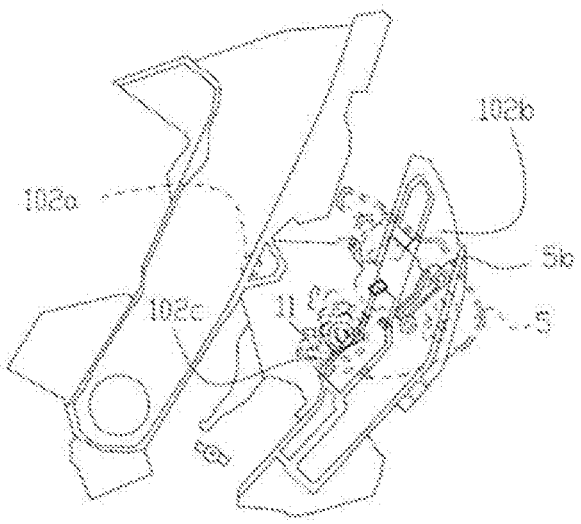
FIG. 30 is a partial structural diagram of a process cartridge installed in a rail according to a ninth embodiment of the present invention.

As shown in FIGS. 29 and 30, when the support projection 5*b* is installed in the first virtual area X1 during installation of the developing cartridge 1, a largest outer edge portion of the power receiving part 11 will interfere with one of outer walls 102*c* of the second rail 102, so it is necessary to further provide a driving force receiving assembly structure which does not interfere with the outer wall 102*c*.

Figure 31:
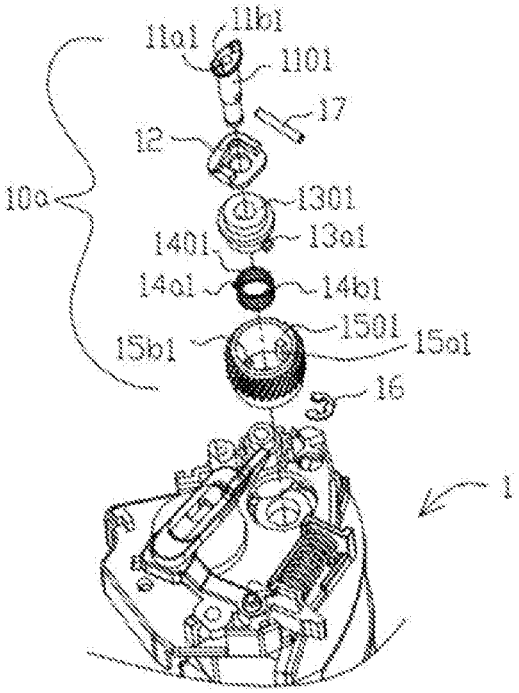
FIGS. 31 and 32 are partial exploded structural diagrams of a process cartridge driving side according to a ninth embodiment of the present invention.

As shown in FIG. 31, in an improved scheme of this embodiment, the driving force receiving assembly 10*a* comprises a power receiving part 1101, a pressing block 12, a power transmitting part 1301, a first elastic member 1401, a gear part 1501, a restricting member 16, and a bolt 17. In the improved scheme, the shape of the outer edge 11*b*1 of the power receiving part 1101 is substantially oval, the substantially oval outer edge 11*b*1 has a long side connecting two sharp points of the oval and a short side perpendicular to the long side, and the receiving claw part 11*a*1 is arranged on the long side of the outer edge 11*b*1. The outer edge 11*b*1 may also be set into other shapes, which only need to satisfy the requirement of having a long side and a short side in a radial direction. A third elastic member 1401 comprises a first connecting end 14*a*1 and a second connecting end 14*b*1. The gear part 1501 is provided with a first end connecting part 15*a*1, the power transmitting part 1301 is provided with a second end connecting part 13*a*1, the first connecting end 14*a*1 is connected with the first end connecting part 15*a*1, and the second connecting end 14*b*1 is connected with the second end connecting part 13*a*1. Ribs 15*b*1 are arranged in the gear part 1501 to be matched with the bolt 17, and the bolt can move in the space, excluding the ribs 15*a*1, of the gear part 1501. The third elastic member 1401 is preferably configured as a torsion spring. The connection of the power transmitting part 1301 and the gear part 1501 through the third elastic member 1401 allows the power transmitting part 1301 to have a certain free rotation space in the gear part 1501, and an initial state of the power transmitting part 1301 is set to be rotatable in both a forward direction and a reverse direction with respect to the gear 1501. When the developing cartridge 1 is mounted along the positioning rail 102*b*, the power receiving part 1101 can pass over the outer wall 102*c* in the second rail 102 using the short side portion in the substantially oval outer edge 11*b*01. Even when the long side of the substantially oval outer edge 11*b*01 faces the outer wall 102*c*, the power receiving part 1101 can rotate freely by a certain angle to allow the short side to face the outer wall 102*c* instead, so that the improved developing cartridge 1 can be flexibly installed into the imaging device.

Figure 32:
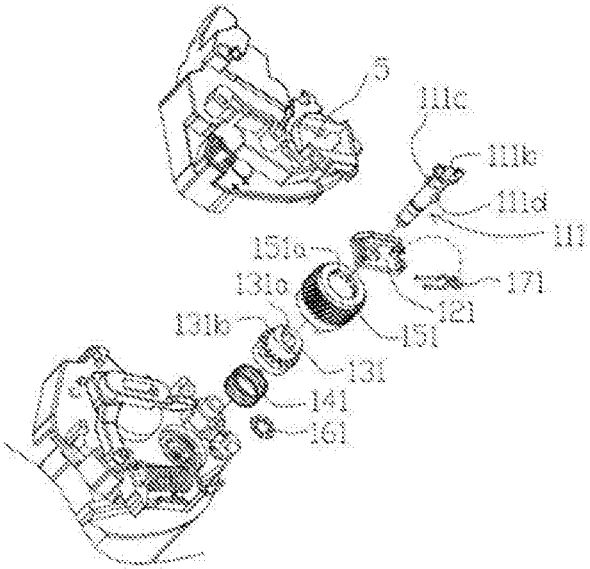

As shown in FIG. 32, another modification of the driving force receiving assembly of the developing cartridge 1 comprises a power receiving part 111, a pressing block 121, a gear part 151, a fourth elastic member 141, a power transmitting part 131, and a restricting member 161. The power receiving part 111 has a substantially oval outer edge 111*b* and a power transmitting projection 111*d*, and the power transmitting part 131 comprises a receiving groove 131*a* to be matched with the power transmitting projection 111*d*. The power transmitting part 131 is provided with a first disk gear 131*b*, and the gear part 151 is provided with a second disk gear 151*a* matched with the first disk gear 131*b*. The power transmitting part 131 is disposed below the gear part 151 closer to an inner side of the developing cartridge 1, and the fourth elastic member 141 is disposed below the power transmitting part 131 closer to the inner side of the developing cartridge 1. When the control mechanism in the developing cartridge 1 controls the power receiving part 111 to retract, the power transmitting part 131 also retracts accordingly, the first disk gear 131*b* disengages from the second disk gear 151*a*, and the power receiving part 111 can freely rotate relative to the gear part 151. When the developing cartridge 1 is mounted in the imaging device along the second rail 102, if the power receiving part 111 interferes with the outer wall 102*c* of the second rail 102, the power receiving part 111 can freely rotate so that the short side of the outer edge 111 faces the outer wall 102*c* to realize flexible mounting. It is further preferable that a holding component 171 may be installed on the pressing block 121, the power receiving part 111 is provided with an oval abutting part 111*c* matched with the holding component 171, and the protecting cover 5 is provided with a restricting part to restrict the rotation of the pressing block 121. When the power receiving part 111 retracts and the power receiving part 111 rotates freely relative to the gear part 151, the holding component 171 can hold the power receiving part 111 in a held position, which is arranged in the following manner: when the developing cartridge 1 is installed in the imaging device along the second rail 102, the held position makes the short side of the outer edge 111*b* of the power receiving part 111 face the outer wall 102*c* of the second rail, avoiding the process that the power receiving part 111 needs to be touched by the outer wall 102*c* to rotate, thus making the installation of the developing cartridge 1 more convenient and stable.

The process cartridge provided by the embodiment adopts a new developing cartridge driving mechanism, has a simple structure and stable power transmission, and solves the technical problem in the prior art that a universal joint needs to be pivoted repeatedly after being installed in an imaging device, leading to unsmooth pivoting, and therefore the universal joint cannot normally engage with a driving head in the imaging device.

The above embodiments are only used to illustrate the technical scheme of the present invention, not to limit it. Although the present invention has been described in detail with reference to the foregoing embodiments, it should be understood by those skilled in the art that they can still modify the technical scheme described in the foregoing embodiments or replace some of its technical features equally, while these modifications or substitutions do not make the essence of the corresponding technical scheme depart from the spirit and scope of the technical scheme of various embodiments of the present invention.

What is claimed is:

1. A control mechanism for use in a process cartridge, the process cartridge being detachably mounted in an imaging device;

the process cartridge comprising a casing provided with a developer containing part;

the imaging device comprising:

a rotatable driving head for outputting a driving force; and a force applying assembly arranged in the imaging device and capable of reciprocating along with the operation of the imaging device, the force applying assembly having a force applying part, wherein the process cartridge comprising a power receiving part which can extend and retract along a first direction of its own rotation axis direction, and the power receiving part being capable of engaging with the driving head to receive the driving force from the driving head;

wherein the control mechanism comprises a force receiving member, the force receiving member receives the force of the force applying part to move, an elastic member configured to urge the force receiving member to move, and the control mechanism controls the extension and retraction of the power receiving part by the movement of the force receiving member, when the force receiving member moves against the force of the elastic member, and the control mechanism controls the power receiving part to extend out to engage with the driving head.

2. The control mechanism according to claim 1, wherein the process cartridge comprises a pressing block, the pressing block is provided with a pressed part, the control mechanism comprises a force transmitting mechanism movably connected to the force receiving member, and the force receiving member moves to drive the force transmitting mechanism to move and press the pressed part, so as to control the power receiving part to extend and retract in the first direction.

3. The control mechanism according to claim 2, wherein the force transmitting mechanism is provided as a link movably connected with the force receiving member, the pressing block can rotate relative to the power receiving part, and the link controls the extension and retraction of the power receiving part by pressing the pressed part.

4. The control mechanism according to claim 1, wherein the force applying part of the force applying assembly is capable of either moving away from or moving towards the force receiving member.

5. The control mechanism according to claim 4, wherein the force applying part of the force applying assembly is capable of pulling the force receiving member to make the power receiving part retract and disengage from the driving head.

6. The control mechanism according to claim 1, wherein the force applying part of the force applying assembly is capable of pulling the force receiving member to make the power receiving part retract and disengage from the driving head.

7. A process cartridge detachably mounted in an imaging device, the imaging device comprising:

a rotatable driving head for outputting a driving force; and a force applying assembly arranged in the imaging device and capable of reciprocating along with the operation of the imaging device, the force applying assembly having a force applying part;

the process cartridge comprising:

a casing provided with a developer containing part;

a developer bearing member rotatably supported on the casing; and a driving force receiving assembly, the driving force receiving assembly comprising a power receiving part, the power receiving part being capable of extending and retracting along a first direction of its own rotation axis, and the power receiving part engaging with the driving head to receive the driving force from the driving head when extending out;

the developer bearing member rotating by receiving the force of the driving force receiving assembly;

further comprising a control mechanism for controlling the extension and retraction of the power receiving part, wherein the control mechanism receives the force of the force applying part to control the extension and retraction of the power receiving part; the control mechanism comprises a force receiving member matched with the force applying part; the imaging device further comprises a photosensitive cartridge detachably installed in the imaging device and having an image bearing member; an elastic member configured to urge the force receiving member to move; and when the force applying part pushes the force receiving member, the force receiving member urges the elastic member to elastically deform and provides an elastic force to keep the developer bearing member in contact with the image bearing member at a certain pressure.

8. The process cartridge according to claim 7, wherein the control mechanism further comprises a force transmitting mechanism, the driving force receiving assembly is provided with a pressed part, and the force transmitting mechanism transmits an external force received by the force receiving member to the pressed part and presses the pressed part so as to control the power receiving part to extend and retract in the first direction.

9. The process cartridge according to claim 8, wherein the driving force receiving assembly comprises a pressing block, the pressing block can rotate relative to the power receiving part, and the pressed part is arranged on the pressing block.

10. The process cartridge according to claim 9, wherein the force receiving member can rotate around a rotation center, and the elastic member and the force transmitting mechanism are arranged on two sides of the rotation center.

11. The process cartridge according to claim 7, wherein the control mechanism further comprises a force transmitting mechanism, the force transmitting mechanism comprising a force transmitting member rotating around a fulcrum, and the force transmitting member rotating by receiving the force of the force receiving member.

12. The process cartridge according to claim 7, wherein the control mechanism comprises a force receiving member, the driving force receiving assembly has a pressed part, and the force receiving member presses the pressed part to control the extension and retraction of the power receiving part.

13. The process cartridge according to claim 7, wherein the control mechanism comprises a force receiving member matched with the force applying part, and the force receiving member slides by receiving the force of the force applying part and controls the extension and retraction of the power receiving part.

14. A process cartridge detachably mounted in an imaging device, comprising:

a casing capable of containing a developer; and a developer bearing member which can bear the developer;

the developer bearing member being capable of conveying the developer to an image bearing member arranged outside the casing, and the developer bearing member and the image bearing member being capable of moving between a contact position and a separation position;

wherein the process cartridge comprises a power receiving part which can extend and retract along a first direction of its own rotation axis direction, and the power receiving part can engage with the driving head to receive a driving force from the driving head; and the process cartridge further comprises a control mechanism which controls the extension and retraction of the power receiving part, and the control mechanism urges the developer bearing member to make contact with the image bearing member at a certain pressure while controlling the power receiving part to extend out to engage with the driving head.

15. The process cartridge according to claim 14, wherein a force applying assembly capable of reciprocating along with the operation of the imaging device is arranged in the imaging device, and the force applying assembly having a force applying part;

the control mechanism comprises a force receiving member, and the force receiving member receives the force of the force applying part to control the power receiving part to extend and retract.

16. The process cartridge according to claim 14, wherein the control mechanism comprises a force receiving member which can receive an external force to move, an elastic member is arranged between the force receiving member and the casing, the force receiving member compresses the elastic member when receiving the external force to allow the developer bearing member to make contact with the image bearing member at a certain pressure while controlling the power receiving part to extend out, and the elastic force of the elastic member can push the force receiving member and control the power receiving part to retract when the force receiving member does not receive the external force.

17. The process cartridge according to claim 14, wherein a force applying assembly which can reciprocate along with the operation of the imaging device is arranged in the imaging device, and the force applying assembly is provided with a force applying part; the control mechanism comprises a force receiving member, and an elastic member is arranged between the force receiving member and the casing; and the force receiving member can receive the force of the force applying part to move, the elastic member can be pressed by the movement of the force receiving member so that the developer bearing member makes contact with the image bearing member at a certain pressure, and at the same time the power receiving part is controlled to extend out to engage with the driving head.

18. The process cartridge according to claim 17, wherein the imaging device is internally provided with a force applying assembly which can reciprocate along with the operation of the imaging device, the control mechanism comprises a force receiving member which receives the force of the force applying part, the force receiving member is rotatable about a rotation center, and the force receiving member has two opposite ends with respect to the rotation center, with one end abutting against the elastic member so as to press the elastic member, and the other end controlling the extension and retraction of the power receiving part.

19. The process cartridge according to claim 14, wherein the imaging device is internally provided with a force applying assembly which can reciprocate along with the operation of the imaging device, the force applying assembly is provided with a first force applying part and a second force applying part, the control mechanism comprises a force receiving member, the force receiving member is provided with a first stressed part and a second stressed part, the second stressed part receives the force of the second force applying part to make the force receiving member move and control the power receiving part to extend out, and the first stressed part can receive the force of the first force applying part to make the force receiving member move and drive the developer bearing member to be separated from the image bearing member.

* * * * *